US007357377B2

(12) United States Patent
Glover et al.

(10) Patent No.: US 7,357,377 B2
(45) Date of Patent: Apr. 15, 2008

(54) CARBURETTORS

(75) Inventors: Stephen Brian Glover, Killarney (IE); Stephen Morris, Arundel (IE)

(73) Assignee: Ricardo UK Limited, West Sussex (GB)

( * ) Notice: Subject to any disclaimer, the term of this patent is extended or adjusted under 35 U.S.C. 154(b) by 0 days.

(21) Appl. No.: 10/572,330

(22) PCT Filed: Sep. 16, 2004

(86) PCT No.: PCT/GB2004/003987

§ 371 (c)(1),
(2), (4) Date: Jan. 10, 2007

(87) PCT Pub. No.: WO2005/026520

PCT Pub. Date: Mar. 24, 2005

(65) Prior Publication Data

US 2007/0114680 A1 May 24, 2007

(30) Foreign Application Priority Data

Sep. 18, 2003 (GB) ..... 0321828.6

(51) Int. Cl.
*F02M 7/24* (2006.01)

(52) U.S. Cl. ..... 261/46; 123/73 PP; 261/47; 261/63; 261/DIG. 1

(58) Field of Classification Search ..... 261/23.2, 261/46, 47, 63, DIG. 1; 123/73 PP
See application file for complete search history.

(56) References Cited

U.S. PATENT DOCUMENTS

| | | | | |
|---|---|---|---|---|
| 6,702,262 | B2 * | 3/2004 | Nonaka | 261/50.2 |
| 6,755,395 | B2 * | 6/2004 | Nickel | 261/23.2 |
| 6,889,637 | B2 * | 5/2005 | Rosskamp | 123/73 PP |
| 7,011,298 | B2 * | 3/2006 | Gerhardy et al. | 261/46 |
| 2003/0106508 | A1 * | 6/2003 | Rosskamp | 123/73 PP |
| 2004/0075180 | A1 * | 4/2004 | Nonaka | 261/50.2 |

FOREIGN PATENT DOCUMENTS

| | | |
|---|---|---|
| DE | 101 60 539 | 6/2003 |
| WO | WO 99/58829 | 11/1999 |

OTHER PUBLICATIONS

Patent Abstracts of Japan: Publication No. 2001-295652 published Oct. 26, 2001, Zama Japan KK, (Application No. 2000-111728 filed Apr. 13, 2000) Stratified Scavenging Two-Cycle Engine.

* cited by examiner

*Primary Examiner*—Richard L. Chiesa
(74) *Attorney, Agent, or Firm*—Cowan, Liebowitz & Latman

(57) ABSTRACT

A carburettor is connected into the inlet duct (48) of an internal combustion engine. The inlet duct is divided by a dividing wall (64) into a rich passage (42) and a lean passage (44). The carburettor includes a fuel chamber (4) and defines a flow duct divided by a planar partition (66) into a rich duct (30) and a lean duct (32) which communicate with the rich and lean passages, respectively. The partition (66) defines an aperture (40) in which a planar butterfly valve (20) is pivotably mounted. A number of fuel supply orifices (61, 62) communicate with the fuel chamber (4) and with the duct (30) at a position opposite to the aperture (40). The butterfly valve (20) is pivotable between an open position, in which the flow duct is substantially open and the aperture (40) is substantially closed and all of the fuel flowing out of the fuel supply orifices (61, 62) flows into the rich duct (30), and a closed position, in which the flow duct is substantially closed and the aperture (40) is substantially open and the fuel flowing out of the fuel supply orifices flows into to both the rich and lean ducts. An idle fuel supply orifice (8) is provided in the dividing wall (64) and communicates with the rich and lean passages (42, 44) and with the fuel chamber (4) and with the atmosphere. Under idling operation of the engine, an air/fuel mixture is induced into the rich and lean passages not only through one of the fuel supply orifices (61) but also through the idle fuel supply orifice (8).

8 Claims, 2 Drawing Sheets

CARBURETTORS

CROSS-REFERENCES TO RELATED APPLICATIONS

This application claims priority to International Application No. PCT/GB2004/003987 filed Sep. 16, 2004, which claims priority to Great Britain Application No. 0321828.6 filed Sep. 18, 2003, the entire disclosures of which are hereby incorporated by reference.

The present invention relates to carburettors of the type disclosed in WO 99/58829. Such carburettors are intended for use with two-stroke engines whose inlet duct is divided into two separate passages, referred to as a rich passage and a lean passage. The carburettor is arranged to direct a rich fuel/air mixture into the rich passage and a weak mixture or substantially pure air into the lean passage at high engine load, when the carburettor butterfly valve is substantially fully open, but to direct a substantially equally rich mixture into both of the rich and lean passages at low engine load, when the butterfly valve is substantially closed.

The engine with which the carburettor is used is of the crankcase-scavenged type and is arranged so that the combustion space is filled with a stratified charge, that is to say a charge whose fuel/air ratio varies over the volume of the combustion space, at high engine load but with a substantially homogeneous charge, that is to say a charge whose fuel/air ratio is substantially the same over the volume of the combustion space, at low engine load. This is achieved at the engine disclosed in WO 99/58829 by dividing the interior of the crank case into two or more separate volumes, one of which, referred to as the rich volume, communicates with the rich passage, and the other of which, referred to as the lean volume communicates with the lean passage. The rich and lean volumes communicate with the combustion space at different positions.

Under high engine load, the combustion space is scavenged primarily with substantially pure air from the lean volume. The remaining pure air and the rich fuel/air mixture from the rich volume do not mix thoroughly and the charge is stratified. Under low load, a similar relatively weak fuel/air mixture is introduced into both the rich and lean volumes and the charge in the combustion space is therefore substantially homogeneous.

The carburettor disclosed in WO 99/50029 is shown highly schematically in FIG. 1. The carburettor is connected to the inlet duct 48 of a two-stroke engine, which is divided by a partition 64 into a rich passage 42 and a lean passage 44. The carburettor defines a flow duct which is divided by a substantially planar partition 66 into two ducts, a rich duct 30 and a lean duct 32. Communicating with the rich duct are a number of spaced small fuel jets or orifices 61, referred to as progression holes, arranged in a line in the flow direction and a main fuel jet 62. These fuel jets are directed generally towards a circular aperture 40 formed in the partition 66. A substantially planar butterfly valve 20 is received in the aperture so as to be pivotable between a first position, in which the flow duct is substantially closed and the aperture 40 is substantially open, and a second position, in which the flow duct is substantially open and the aperture 40 is substantially closed.

One of the greatest challenges to current engine design is the increasing need for reduced exhaust emissions. This challenge continues to grow as the number of engines in service increases and ever more stringent emissions legislation is continually introduced by Governments. Even small improvements in emissions levels of an engine are of great significance when multiplied across thousands or millions of engines. The carburettor disclosed in WO 99/58829 makes a significant contribution to the reduction in emissions levels of crankcase-scavenged two-stroke engines.

One application for such engines is in connection with relatively small handheld products, such as chain saws, strimmers and the like. It is crucial that the engines of such handheld equipment functions correctly, that is to say operates at full speed and idling speed, when positioned out of the vertical, that is to say with the axis of the engine cylinder and the carburettor extending other than vertically, that is to say not in the "normal" orientation. The normal orientation of an engine can be considered to be that in which the metering diaphragm of the carburettor flow chamber extends substantially at 90° to the earth's gravitational pull. It is also that orientation at which the engine and fuel system are normally situated during design and development testing on a fixed test stand.

It is common practice to test acceptable operation of such engines by setting it at idle speed at the normal orientation and then rotating it or slowly rolling it bodily for one or two minutes in a series of 90° steps. The engine will pass the test if it continues to operate satisfactory with minimal variation of the running speed. Thus if the engine should be idling at, say, 2800 rpm after having been inverted from the normal orientation, the idle speed should not alter by, say, more than 300 rpm once the orientation of the engine is returned to normal. This test procedure is referred to as roll-in roll-out.

It has been found that carburettors of the type disclosed at WO 99/58829 can, under certain circumstances, fail the requirement for substantially constant idle speed in a roll-in roll-out test. It is of particular importance when conducting a roll-in roll-out test that the fuel mixture control at idle speed is highly accurate and provides the correct air/fuel ratio for smooth idle performance. It is also extremely important that the appropriate degree of atomisation of the fuel is achieved in order to prevent the formation of fuel droplets within the inlet conduit because if such droplets coalesce and then break free they can adversely effect the roll-in roll-out performance.

It is therefore the object of the invention to provide a carburettor of the type disclosed in the prior document which exhibits a reliable and satisfactory performance of the idle speed when subjected to a roll-in roll-out test.

According to one aspect of the present invention, there is provided a carburettor for supplying fuel into the inlet duct of an internal combustion engine, the inlet duct being divided by a dividing wall over at least part of its length into two inlet passages, a rich passage and a lean passage, the carburettor including a fuel chamber and defining a flow duct divided by a substantially planar partition into a rich duct and a lean duct which communicate, in use, with the rich passage and the lean passage, respectively, the partition affording an aperture in which a substantially planar butterfly valve is pivotally mounted, at least one fuel supply orifice communicating with the fuel chamber and with the rich duct at a position opposite to the aperture, the butterfly valve being pivotable between an open position, in which the flow duct is substantially open and the aperture is substantially closed and substantially all of the fuel flowing out of the fuel supply orifice flows into the rich duct, and a closed position, in which the flow duct is substantially closed and the aperture is substantially open and the fuel flowing out of the fuel supply orifice flows into both the rich and lean ducts, characterised by an air bleed idle system comprising an idle fuel supply orifice communicating with the rich and lean ducts and with the fuel chamber and with atmosphere, whereby, under idling operation of the engine, an air fuel mixture is induced into the rich and lean ducts through the idle fuel supply orifice.

In practice, the carburettor will include at least two fuel supply orifices, namely at least one idling orifice or jet and a main orifice or jet. Under idling operation, fuel is introduced into the rich duct not only through one or more idling orifices but also through the idle fuel supply orifice. The idle fuel supply orifice is subjected to the reduced pressure which prevails in the flow duct of the carburettor and this reduced pressure draws in not only fuel from the fuel chamber, in practice the diaphragm float chamber, of the carburettor, but also air through the air passage to which the idle fuel supply orifice is also connected. The air and fuel mix intimately in the passage before being discharged into the rich and lean ducts and the fuel is therefore substantially pre-atomised/vaporised. This results in a reduced tendency for fuel droplets to agglomerate in the inlet duct and thus in an improved performance of the engine when subjected to a roll-in roll-out test.

The carburettor could be provided with two idle fuel supply orifices communicating with the rich duct and the lean duct, respectively, but it is preferred that there is only a single idle fuel supply orifice situated in the partition and communicating with both the rich and lean ducts.

In the embodiment described above, the idle fuel supply orifice is situated in the planar partition of the carburettor and therefore forms part of the carburettor itself. It will, however, be appreciated that it is equally possible for the idle fuel supply orifice to be formed in the inlet duct and to communicate with a passage in the inlet duct which in turn communicates, when the inlet duct is connected to the carburettor, with an air/fuel passage formed in the body of the carburettor.

Thus according to a further aspect of the present invention, there is provided a carburettor connected into the inlet duct of an internal combustion engine, the inlet duct being divided by a dividing wall over at least a part of its length into two inlet passages, a rich passage and a lean passage, the carburettor including a fuel chamber and defining a flow duct divided by a substantially planar partition into a rich duct and a lean duct which communicate with the rich passage and the lean passage, respectively, the partition affording an aperture in which a substantially planar butterfly valve is mounted, at least one fuel supply orifice communicating with the fuel chamber and with the rich duct at a position opposite to the aperture, the butterfly valve being pivotable between an open position, in which the flow duct is substantially open and the aperture is substantially closed and substantially all of the fuel flowing out of the fuel supply orifice flows into the rich duct, and a closed position, in which the flow duct is substantially closed and the aperture is substantially open and the fuel flowing out of the fuel supply orifice flows into both the rich and lean ducts, characterised by an air bleed idle system comprising an idle fuel supply orifice communicating with the rich and lean passages and with the fuel chamber and with atmosphere, whereby, under idling operation of the engine, an air/fuel mixture is induced into the rich and lean passages through the idle fuel supply orifice.

Whilst there may again be two idle fuel supply orifices communicating with respective inlet passages of the inlet duct, it is preferred that there is a single idle fuel supply orifice situated in the dividing wall and communicating with both the rich and lean passages.

The passage leading to the idle fuel supply orifice will necessarily be branched, one branch communicating with the fuel chamber of the carburettor and the other branch communicating with a source of atmospheric air. It is of course highly desirable that the air which is introduced is free of all particulates and that the air passage therefore includes a filter or is supplied with filtered air. A supply of filtered air is of course readily available in the inlet duct upstream of the carburettor but downstream of the air filter that is conventionally provided and it is preferred that the air passage communicates with the inlet duct at a position between the air filter and the venturi portion of the carburettor which is conventionally provided.

In practice, the carburettor of the prior document will have included an idle fuel orifice in addition to the progression orifices. The progression orifices are positioned so that they are upstream at the butterfly valve, when it is closed, but the idle orifice is downstream of it so that, when the engine is idling, all the necessary fuel is supplied through the idle orifice. However, the provision of the air bleed idle orifice in accordance with the invention permits the previous idle orifice to be omitted so that, when the engine is idling, all the necessary fuel is supplied through the air bleed idle orifice. It is thus preferred that, in use, air flows through the flow conduit in a flow direction and the carburettor includes a plurality of fuel supply orifices consisting of one relatively large and a plurality of relatively small progression fuel orifices, which are situated downstream of the main fuel orifice and are positioned such that they are all upstream at the butterfly valve, when it is in a closed position and are progressively uncovered by the butterfly valve when it moves towards the open position.

Further features and details of the invention will be apparent from the following description of one specific embodiment which is given by way of example with reference to FIGS. 2 to 4 of the accompanying highly diagrammatic drawings, in which.

Figure 1:
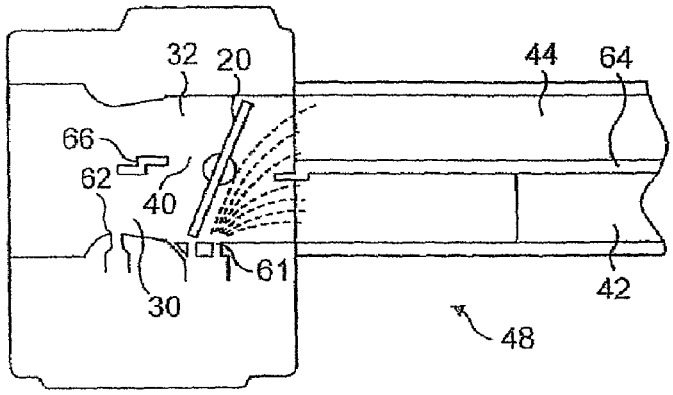
FIG. 1 PRIOR ART
Figure 2:
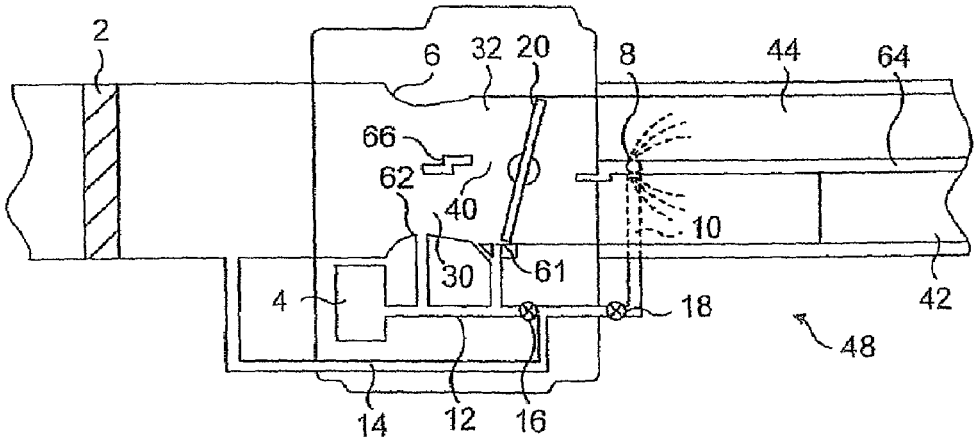
FIG. 2 is a view similar to FIG. 1 showing a carburettor in accordance with the invention with the butterfly valve in the substantially closed position, whereby the engine operates at idling speed.
Figure 3:
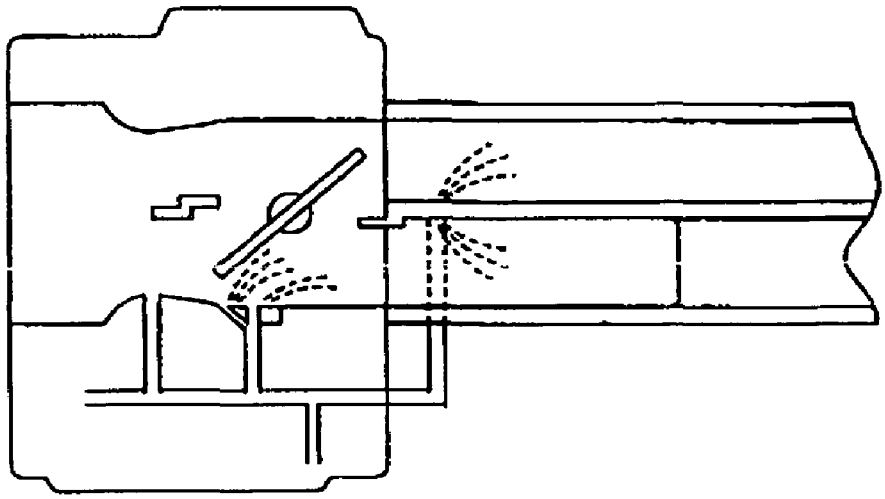
FIG. 3 is a similar view showing the butterfly valve in the partially open position, whereby the engine operates at a moderate speed.
Figure 4:
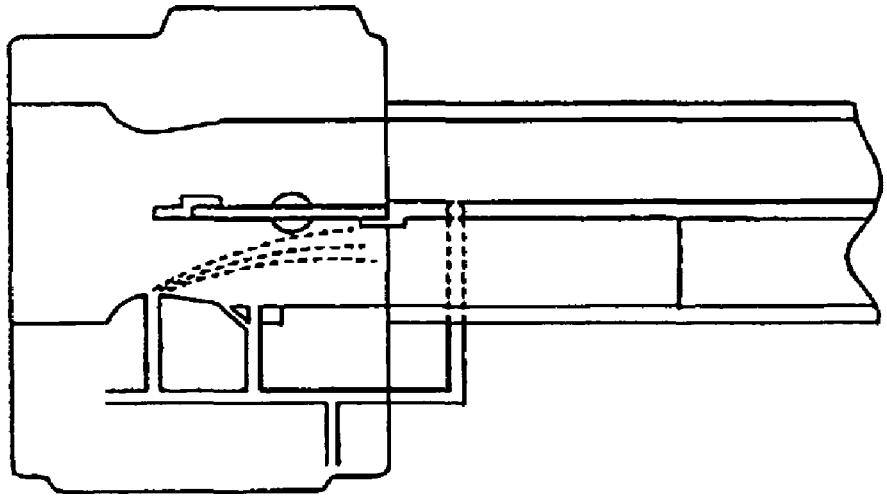
FIG. 4 is a further similar view showing the butterfly valve in the fully open position, whereby the engine operates at full speed.

The carburettor shown in FIGS. 2 to 4 is very similar to the known carburettor illustrated in FIG. 1 but in FIG. 2, an upstream portion of the inlet duct 48 has also been shown and an air filter 2 is schematically illustrated in that portion of the inlet duct. A fuel chamber 4, namely the diaphragm float chamber, is also shown diagrammatically in the body of the carburettor. It will be seen that the size and shape of the inlet end of the flow duct within the carburettor correspond to those of the adjacent connected portion of the inlet duct but that shortly downstream there is a venturi portion 6 at which the cross sectional area of the flow duct decreases and this of course produces an increase in the velocity and a decrease in the pressure of the air flowing through the carburettor.

More importantly, the carburettor shown in FIGS. 2 to 4 also includes an air bleed idle system. This comprises an idle fuel supply orifice 8 formed in the dividing wall 64 of the portion of the inlet duct 48 downstream of the carburettor. The orifice 8 is connected to an idle air/fuel passage 10 which extends transversely through the dividing wall 64 and then through the wall of the inlet duct 48. The passage continues extends within the body of the carburettor and then branches to constitute a fuel passage 12, which communicates with the fuel chamber 4 and with the various fuel jets 5 and 61, and an air passage 14. The air passage 14 communicates with the portion of the inlet duct 48 upstream of the venturi portion 6 of the carburettor and downstream of the air filter 2. No idle orifice is formed in the body of the carburettor.

When the engine is running at idle speed as shown in FIG. 2, the butterfly valve 20 is in the substantially closed position and there is therefore a relatively low mass flow rate of air through the flow duct of the carburettor in comparison to that under high or moderate load operation. However, even under low throttle or idling operation, the inlet duct downstream of the butterfly valve is subjected to a reduced pressure created by the piston(s) of the engine drawing against the substantially closed butterfly valve. This reduced pressure draws liquid fuel from the idling jet 61. It also draws fuel and air through the passage 10 from the fuel chamber 4 through the passage 12 and from the inlet duct through the passage 14 out through the orifice 8. Due to the fact that the fuel and air come into intimate contact some distance upstream of the orifice 8, the fuel is in a highly pre-atomised and/or pre-vaporised state at the time it enter the rich and lean passages of the inlet duct. Improved control of the premixed air and fuel in the passage 10 may be achieved by providing a selectively actuable control valve at one or more of the positions marked 16 and 18 and within the orifice 8 itself. These control valves, which in practice will be controlled by the engine management system, which is commonly provided, permit fine adjustment of the volume of air and/or fuel to be effected.

As the throttle valve is progressively opened to move operation of the engine from the idling condition towards the full load condition, it is necessary to increase the rate of supply of the fuel through a series of intermediate steps. As may be seen in FIG. 3, as the butterfly valve 20 is gradually opened, the progression holes 61 are successively brought into communication with the reduced pressure created downstream of the butterfly valve. At the same time, an increased volume of air is permitted to flow through the inlet conduit. Fuel is drawn from the progression holes in increasing volume to ensure that the correct air/fuel ratio is maintained. During this intermediate stage, fuel mixed with and/or vaporised in air is also admitted into the inlet duct thorough the orifice 8. However, as the butterfly valve opens, the progression holes 61 will gradually supply more fuel than the idle orifice 8 until substantially all the fuel is supplied through the progression holes 61.

As the butterfly valve is yet more fully opened towards a substantially full throttle position, the idle and progression orifices no longer supply a significant portion of the fuel requirement and substantially all the fuel is supplied through the main jet 62. All of the fuel orifices communicate with the fuel passage 12 and since the area of the main jet 62 is of course significantly greater than that of the other fuel orifices, the fuel is preferentially drawn from the main jet, thereby starving the idle and progression orifices of fuel. As in the known carburettor, substantially all of the fuel from the main jet flows under substantially full throttle operation into the rich passage and substantially only air flows into the lean passage.

In a modified embodiment, which is not illustrated, the partition 66 in the carburettor flow duct is extended somewhat to the right, as seen in FIG. 2. The idle orifice 8 is then formed in the partition 66 and the passage 10 extends wholly within the body of the carburettor. The operation and advantages of this embodiment are wholly identical to those of the embodiment described in detail above and the drawing of it would look substantially the same as FIG. 2, the only difference being that the parting plane dividing the downstream surface of the carburettor and the upstream surface of the adjoining portion of the inlet duct would move to the right, as seen in FIG. 2, of the idle orifice 8.

The invention claimed is:

1. A carburettor for supplying fuel into the inlet duct of an internal combustion engine, the inlet duct being divided by a dividing wall over at least part of its length into two inlet passages, a rich passage and a lean passage, the carburettor including a fuel chamber and defining a flow duct divided by a substantially planar partition into a rich duct and a lean duct which communicate, in use, with the rich passage and the lean passage, respectively, the partition affording an aperture in which a substantially planar butterfly valve is pivotally mounted, at least one fuel supply orifice communicating with the fuel chamber and with the rich duct at a position opposite to the aperture, the butterfly valve being pivotable between an open position, in which the flow duct is substantially open and the aperture is substantially closed and substantially all of the fuel flowing out of the fuel supply orifice flows into the rich duct, and a closed position, in which the flow duct is substantially closed and the aperture is substantially open and the fuel flowing out of the fuel supply orifice flows into both the rich and lean ducts, characterised by an air bleed idle system comprising an idle fuel supply orifice communicating with the rich and lean ducts and with the fuel chamber and with atmosphere, whereby, under idling operation of the engine, an air fuel mixture is induced into the rich and lean ducts through the idle fuel supply orifice.

2. A carburettor as claimed in claim 1 in which there is a single idle fuel supply orifice situated in the partition and communicating with both the rich and lean ducts.

3. A carburettor as claimed in claim 2 in which there is a single idle fuel supply orifice situated in the dividing wall and communicating with both the rich and lean passages.

4. A carburettor as claimed in claim 3 in which the inlet duct includes an air filter upstream of the carburettor and the flow duct includes a venturi portion and the idle fuel supply orifice communicates with the inlet duct at a position between the air filter and the venturi portion.

5. A carburettor as claimed in claim 1 in which, in use, air flows through the flow conduit in a flow direction and the carburettor includes a plurality of fuel supply orifices consisting of one relatively large and a plurality of relatively small progression fuel orifices, which are situated downstream of the main fuel orifice and are positioned such that they are all upstream at the butterfly valve, when it is in a closed position and are progressively uncovered by the butterfly valve when it moves towards the open position.

6. A carburettor connected into the inlet duct of an internal combustion engine, the inlet duct being divided by a dividing wall over at least a part of its length into two inlet passages, a rich passage and a lean passage, the carburettor including a fuel chamber and defining a flow duct divided by a substantially planar partition into a rich duct and a lean duct which communicate with the rich passage and the lean passage, respectively, the partition affording an aperture in which a substantially planar butterfly valve is mounted, at least one fuel supply orifice communicating with the fuel chamber and with the rich duct at a position opposite to the aperture, the butterfly valve being pivotable between an open position, in which the flow duct is substantially open and the aperture is substantially closed and substantially all of the fuel flowing out of the fuel supply orifice flows into the rich duct, and a closed position, in which the flow duct is substantially closed and the aperture is substantially open and the fuel flowing out of the fuel supply orifice flows into both the rich and lean ducts, characterised by an air bleed idle system comprising an idle fuel supply orifice communicating with the rich and lean passages and with the fuel chamber and with atmosphere, whereby, under idling operation of the engine, an air/fuel mixture is induced into the rich and lean passages through the idle fuel supply orifice.

7. A carburettor as claimed in claim 6 in which the inlet duct includes an air filter upstream of the carburettor and the flow duct includes a venturi portion and the idle fuel supply orifice communicates with the inlet duct at a position between the air filter and the venturi portion.

8. A carburettor as claimed in claim 6 in which, in use, air flows through the flow conduit in a flow direction and the carburettor includes a plurality of fuel supply orifices consisting of one relatively large and a plurality of relatively small progression fuel orifices, which are situated downstream of the main fuel orifice and are positioned such that they are all upstream at the butterfly valve, when it is in a closed position and are progressively uncovered by the butterfly valve when it moves towards the open position.

* * * * *